US011597589B2

(12) United States Patent
Connors et al.

(10) Patent No.: US 11,597,589 B2
(45) Date of Patent: Mar. 7, 2023

(54) DRY BULK HOPPER SYSTEM

(71) Applicant: Remcon Plastics Incorporated, Reading, PA (US)

(72) Inventors: Tracy L. Connors, Wyomissing, PA (US); Benjamin R. Schwager, Boyertown, PA (US); Brian L. Scheuring, Sinking Spring, PA (US); Peter J. Connors, Radnor, PA (US)

(73) Assignee: Remcon Plastics Incorporated, Reading, PA (US)

( * ) Notice: Subject to any disclaimer, the term of this patent is extended or adjusted under 35 U.S.C. 154(b) by 261 days.

(21) Appl. No.: 17/202,016

(22) Filed: Mar. 15, 2021

(65) Prior Publication Data

US 2022/0289472 A1 Sep. 15, 2022

(51) Int. Cl.

| | |
|---|---|
| ***B65D 90/12*** | (2006.01) |
| ***B65D 88/30*** | (2006.01) |
| ***B65D 90/00*** | (2006.01) |
| ***B65D 90/14*** | (2006.01) |

(52) U.S. Cl.

CPC ..... *B65D 88/30* (2013.01); *B65D 90/0006* (2013.01); *B65D 90/14* (2013.01)

(58) Field of Classification Search

CPC .... B65D 90/12; B65D 90/0006; B65D 90/14; B65D 88/022; B65D 88/26; B65D 88/30; B65D 88/32; B65D 88/54; A47K 5/1209; A47K 2201/025

USPC ..... 222/460, 183.1, 143, 181.2, 325, 165

See application file for complete search history.

(56) References Cited

U.S. PATENT DOCUMENTS

| | | | | | |
|---|---|---|---|---|---|
| 1,655,533 | A * | 1/1928 | Campagna | B65B 39/005 | 141/378 |
| 1,770,576 | A * | 7/1930 | Leather | B65D 83/06 | 222/548 |
| 3,602,400 | A * | 8/1971 | Cooke | B65D 88/128 | 222/143 |
| 4,398,653 | A * | 8/1983 | Daloisio | B65D 90/205 | 222/143 |
| 5,104,003 | A * | 4/1992 | Stecoza | B67D 3/0029 | 222/88 |
| 5,224,635 | A * | 7/1993 | Wise | B62B 5/0083 | 206/508 |
| 5,490,603 | A * | 2/1996 | Davis | B65D 77/0466 | 220/4.12 |

(Continued)

OTHER PUBLICATIONS

Unknown, "21-1/2 Jumbo Lever Lock Ring", Tri-Sure Industries Ltd., May 24, 2012, 1 page.

(Continued)

*Primary Examiner* — Charles P. Cheyney
(74) *Attorney, Agent, or Firm* — Steven J. Rocci P.C.

(57) ABSTRACT

There is disclosed a dry bulk hopper system that includes a generally frustoconical bottle and a base having a tapered wall that defines a cradle for holding the bottle. The bottle has locking tabs disposed at bottom end thereof that cooperate with engagement ledges to secure the bottle to the base when the bottle has been received into the base in a first orientation, but not in a second orientation. Extruded support columns are disposed inside an interior of the base to distribute loads created by material in the bottle when the system is raised by a forklift.

20 Claims, 13 Drawing Sheets

(56) References Cited

U.S. PATENT DOCUMENTS

| | | | | |
|---|---|---|---|---|
| 5,671,870 | A * | 9/1997 | Megargle | B67D 7/06 D9/438 |
| 5,947,171 | A * | 9/1999 | Woodruff | B65D 81/3211 141/354 |
| 6,247,594 | B1 * | 6/2001 | Garton | B65D 19/385 220/23.91 |
| 7,475,796 | B2 * | 1/2009 | Garton | B65D 90/12 211/183 |
| 9,422,092 | B2 * | 8/2016 | Schutz | B65D 61/00 |
| 10,189,614 | B2 * | 1/2019 | Pruiett | B65D 47/32 |
| 2005/0029425 | A1 * | 2/2005 | Garton | B65D 90/12 220/4.12 |
| 2007/0045355 | A1 * | 3/2007 | Claussen | B67D 3/0083 222/425 |
| 2008/0029553 | A1 * | 2/2008 | Culleton | B65D 88/26 220/737 |
| 2011/0315689 | A1 * | 12/2011 | Meints | B65D 21/0215 220/500 |
| 2012/0024160 | A1 * | 2/2012 | Van Os | A47J 31/42 426/115 |

OTHER PUBLICATIONS

Unknown, "21 Inch BLO-Line Cover", International Precision Components Corporation, Aug. 8, 2008, 1 page.

Unknown, "60° Dry Handling Flowmaster", Snyder Industries Inc., 2017, 1 page.

Unknown, "HB Q/R Adapter/Clamp Ring with Liner Groove", Kemutec Powder Technologies, Jun. 7, 1995, 1 page.

Unknown, "Series H Hand Operated Iris Diaphragm Valve", Mucon Division, Process Components Ltd., Apr. 4, 2000, 1 page.

Pages from https://www.snydernet.com/products/snyder-ibc-totes/dry-material-ibcs/standard-flowmaster, captured Apr. 26, 2021 (admitted prior art).

* cited by examiner

DRY BULK HOPPER SYSTEM

FIELD OF THE INVENTION

The present disclosure relates generally to a hopper system comprising a bottle for receiving and containing material, such as dry bulk materials, and a base for receiving and supporting the bottle, for example, for storage purposes.

BACKGROUND OF THE INVENTION

Rotationally molded dry bulk hopper systems are known. They generally comprise a base with a plurality of legs for supporting a bottle or tank. Typically, these systems are used to hold/store a variety of dry materials such as powders, or granular or pelletized material.

The present disclosure is directed to an improved dry bulk hopper system that has numerous features, including, but not limited to, improved stability, improved structural integrity, reduced manufacturing cost, and a simple and convenient means for securing/removing the bottle to/from the base, as compared to prior art systems.

BRIEF SUMMARY OF THE INVENTION

There is disclosed a thermoplastic, rotationally molded, dry bulk hopper system that comprises a bottle that interlocks with a base. The bottle comprises an upper wall that is generally rectangular in cross section and an integral lower frustoconical wall that tapers to form a circular discharge opening at the bottom of the bottle. There are arcuate transitions between the upper and lower walls that conform to arcuate edges on the base. Integral locking tabs are formed integral with the lower wall adjacent the discharge opening. Disposed on top of the bottle are a plurality of integral, spaced apart support beams, each of which extends from the fill opening to a corner of the upper wall. Apertures on the ends of the support beams are adapted to receive lifting hooks.

The base comprises an outer wall that is generally rectangular in cross section and an inner wall that is tapered to form a cradle adapted to receive and hold the bottle. A circular bottle receiving opening at the bottom of the base is adapted to receive the bottom end of the bottle. Disposed about the bottle receiving opening are a plurality of first and second notches, and engagement ledges formed adjacent the first notches but not the second notches. The bottle may be received into the cradle such that the locking tabs are received into either the first notches or the second notches. When the bottle is in a first orientation relative to the base, the locking tabs are received into the first notches and cooperate with the engagement ledges to secure the bottle to the base by a slight rotation of the bottle. The bottle is unsecured from base by rotation in the opposition direction. When the bottle is in a second orientation relative to the base, the locking tabs are received into the second notches and cannot engage the engagement ledges, such that the bottle is not secured to the base.

The base also comprises integral legs adapted to support the base on a support surface such that the bottle receiving opening is spaced from the support surface by the legs when on the support surface. Disposed on the underside of the base are a pair of forklift pockets defined by a pair of integral brackets, each of which extends from an area adjacent the bottle receiving opening to an edge of the outer wall. Disposed within cavities between the inner and outer walls are support columns extending from the underside of the base to at least the inner wall. Each support column is an elongate hollow extrusion of thermoplastic having portions in continuous contact with portions of the inner and outer walls. When a bottle containing material is disposed in the base, and the base is raised by a forklift, the support columns distribute a load from contents of the bottle to the times of the forklift.

DETAILED DESCRIPTION

Figure 1:
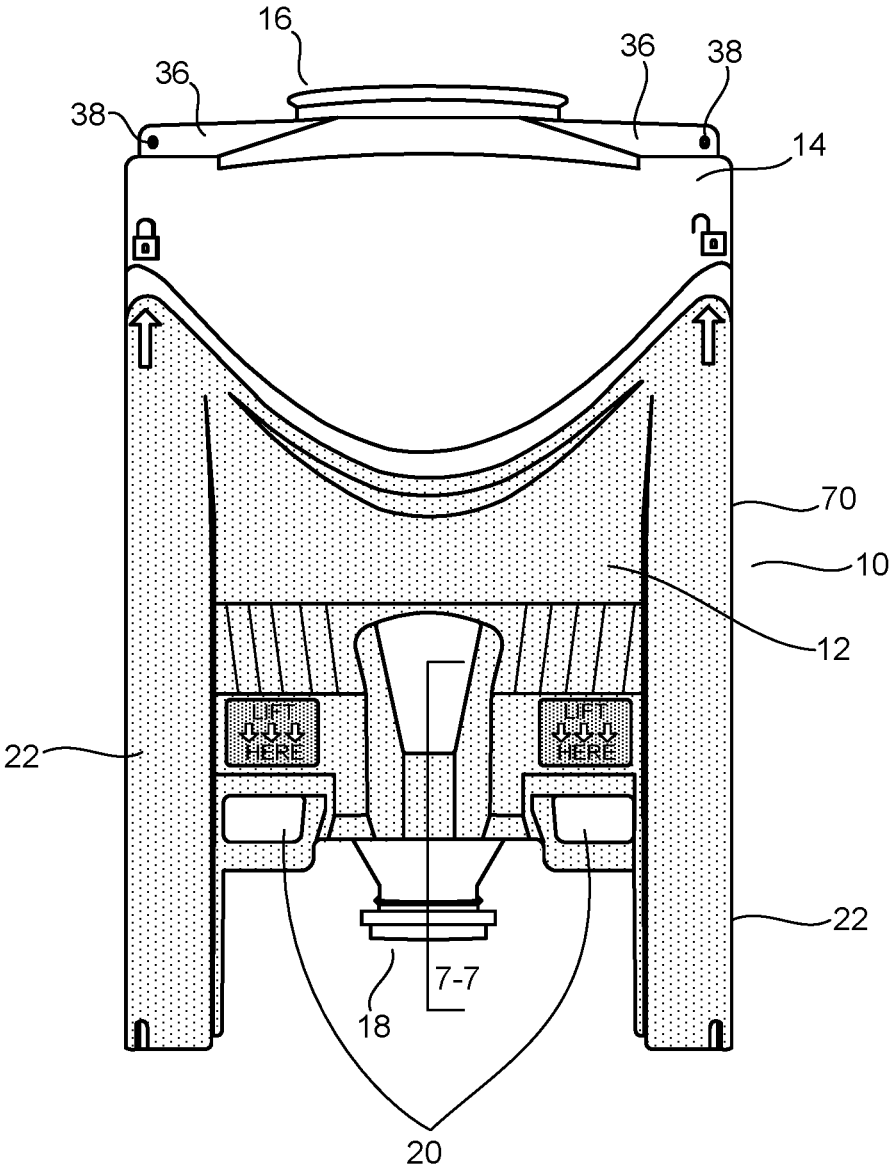
FIG. 1 is a view of one side of a dry bulk hopper system, comprising a bottle and a base, according to one embodiment of the disclosure.

Referring to the drawings, where like numerals represent like elements, there is shown in FIG. 1 a dry bulk hopper system 10 according to one embodiment of this disclosure. The system 10 comprises a base 12 and a bottle 14. The base has an outer wall 70 that is generally rectangular in cross section. As described in more detail below, the shape of the exterior wall of the bottle and the interior wall of the base are complementary such that the bottle can rest in the base. Bottle 14 has a circular fill opening 16 for receiving material disposed at the top end thereof, and a circular discharge opening 18 at the bottom end thereof. Disposed in a bottom area of the base are a pair of forklift pockets 20 for receiving the times of a forklift for transporting the base (and the bottle, if the bottle is in the base). Four legs 22, one disposed at each corner of the base, support the base on a support surface such that the discharge opening of the bottle is spaced from the support surface so that material in the bottle can be emptied.

The bottle and base are each manufactured from a thermoplastic material, preferably through a rotational molding process. Accordingly, each of the elements of the bottle described herein are integrally molded to form the bottle (except as noted, i.e., a lib system for the fill opening and a valve system for the discharge opening are not integrally molded to the bottle), and each of the elements of the base described herein are integrally molded to form the base.

Figure 2:
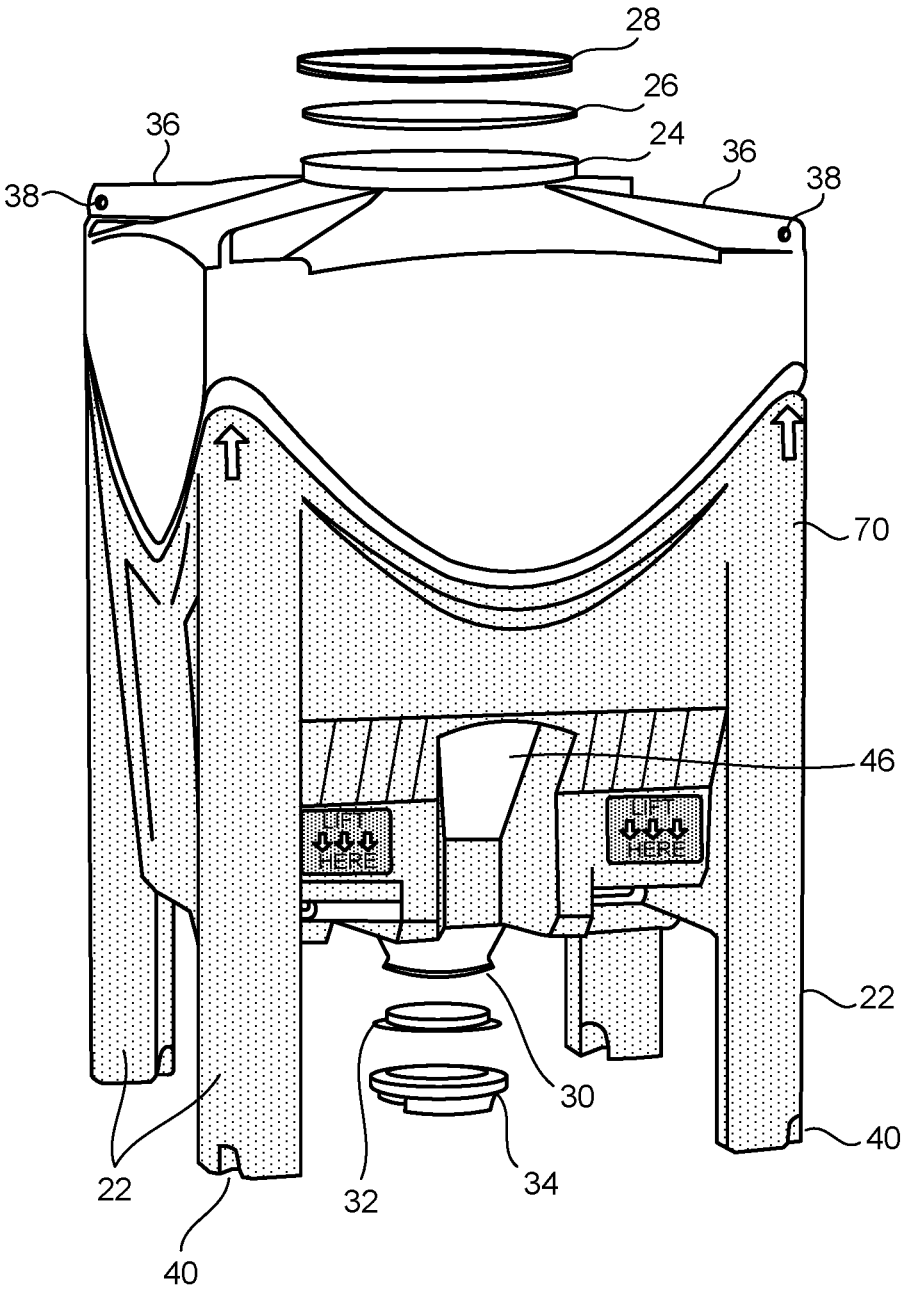
FIG. 2 is a perspective view of the system of FIG. 1, and illustrates, in an exploded view, details of the lib and valve assemblies for the bottle.
Figure 11:
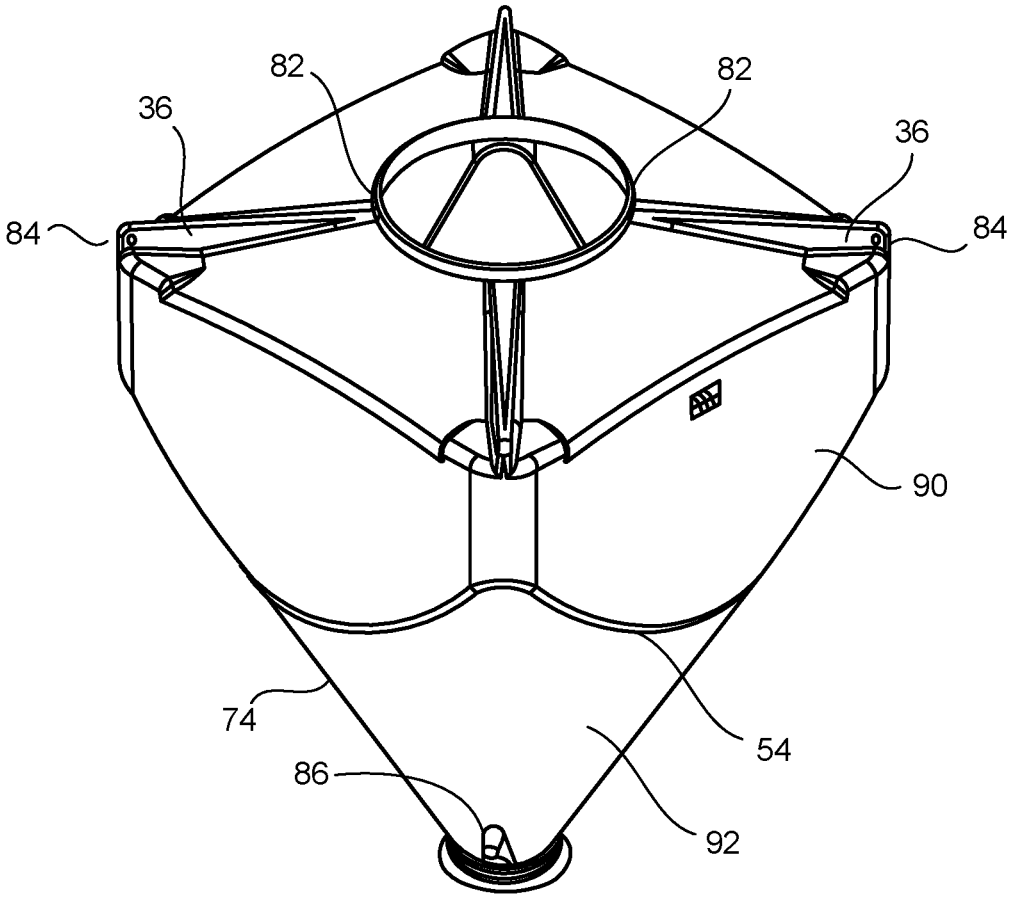
FIG. 11 is a perspective view of the bottle illustrating further details thereof.

Further details of the base and bottle are illustrated in the remaining figures. As shown in FIG. 2, a flange 24 is integrally molded into the top of the bottle to form the periphery of the circular fill opening 16. A removable lib for the bottle comprises a ring 26 that seats onto the flange 24 and receives a removable dust cover 28. Also formed into the top of the bottle are four support beams 36, each extending from the periphery 82 of the fill opening to a corner 84 of the top of the bottle. See FIG. 11. An aperture 38 is disposed adjacent the distal end of each support beam. The apertures 38 are adapted to receive lift hooks from, e.g., a crane or other lifting machine, so as to allow the bottle to be lowered into, and lifted out of, the base. The support beams provide structural integrity to the top of the bottle, especially when systems are stacked, so as to prevent deformity of the bottle, and also to provide structural support while the bottle is being lifted and lowered.

Figure 12:
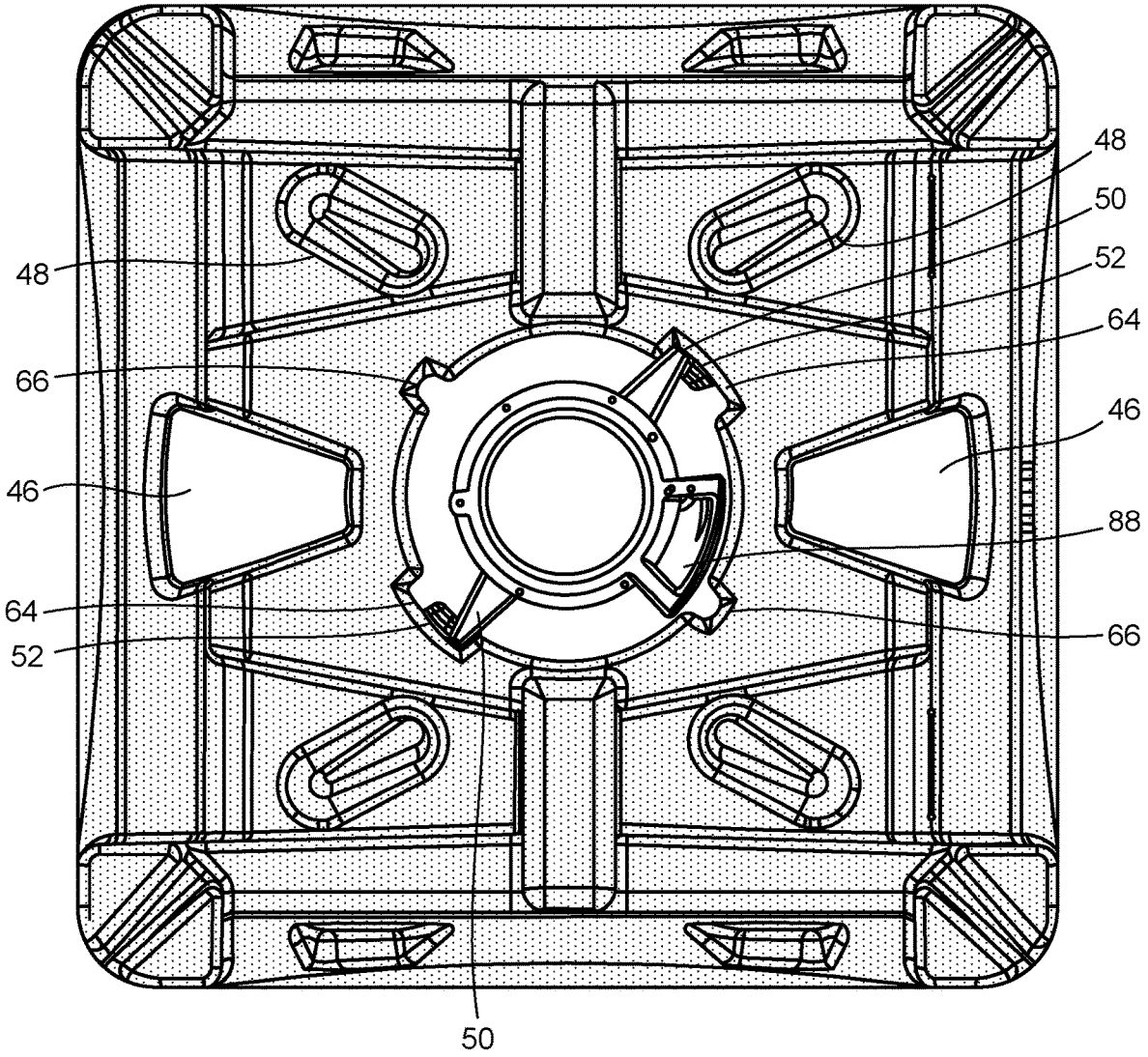
FIG. 12 is a view of the underside of the base and illustrates the bottle disposed therein in the first orientation and locked to the base.

Turing to the bottom end of the bottle, a flange 30 is integrally formed around the periphery of the discharge opening 18 and is adapted to receive a quick release adapter ring 32 which retains a rotatable discharge valve 34. In the disclosed embodiment, the ring 26, dust cover 28, adapter ring 32 and valve 34 are not integral with the bottle. The valve 34 may be a hand operated iris diaphragm valve commercially available from Mucon Schenck Process Group (www.mucon.com), The ring 32 may be a locking lever ring commercially available from Tri-Sure (www.tri-sure.com). As shown in FIG. 12, the valve 34 may have a handle 88 for manually opening and closing the valve by rotation thereof.

Figure 3:
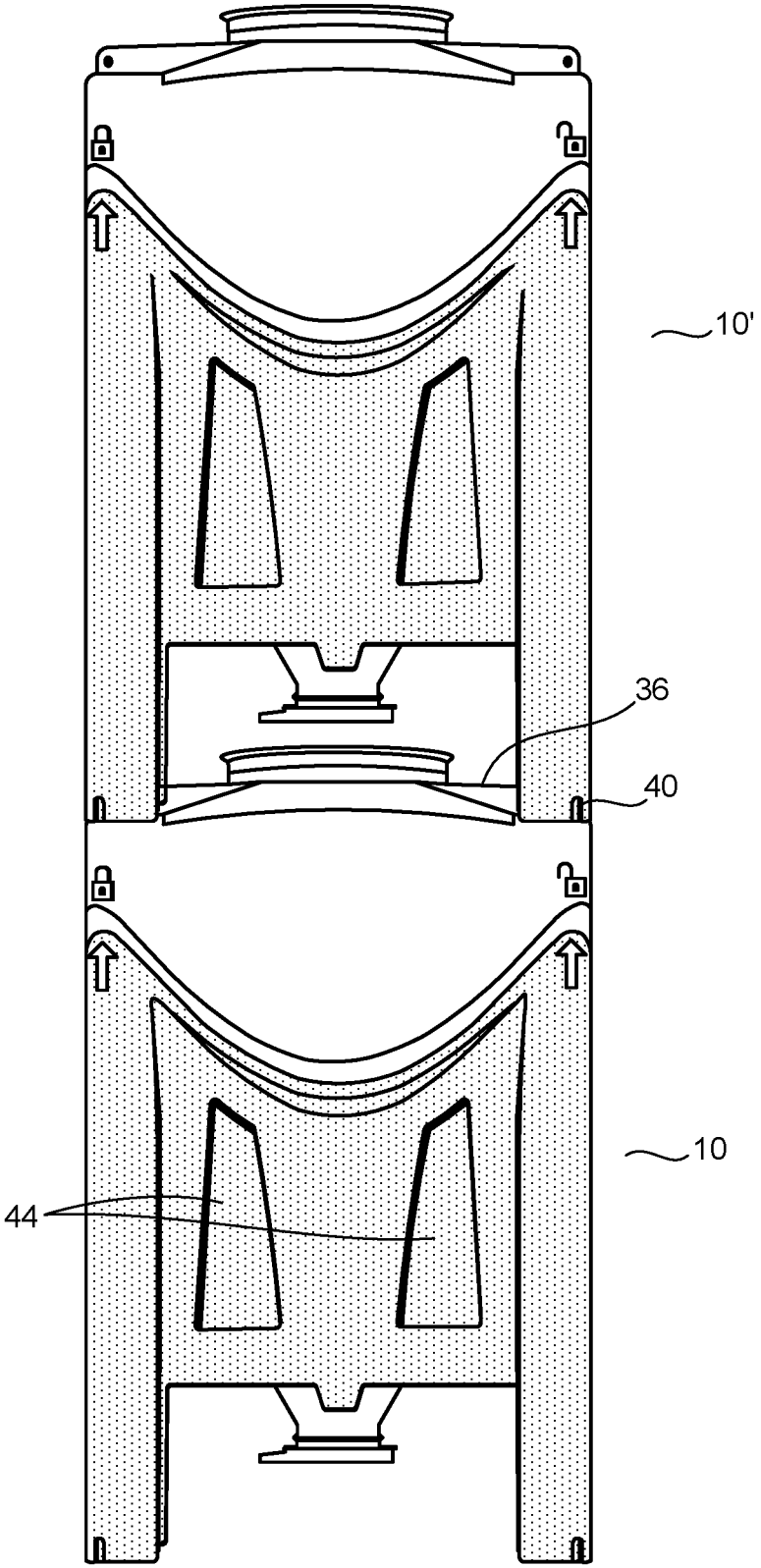
FIG. 3 is a side view of a pair of stacked dry bulk hopper systems.

As also shown in FIG. 2, the base comprises a pair of viewing windows 46 for observing the bottle while it is being received into and removed from the base. Disposed at the bottom of each leg 22 is a notch 40 that cooperates with the edges of the support beams 36 to allow stacking of the hopper systems 10, 10', as shown in FIG. 3. An aesthetic design 44 may be molded into selected walls of the base.

Figure 4:
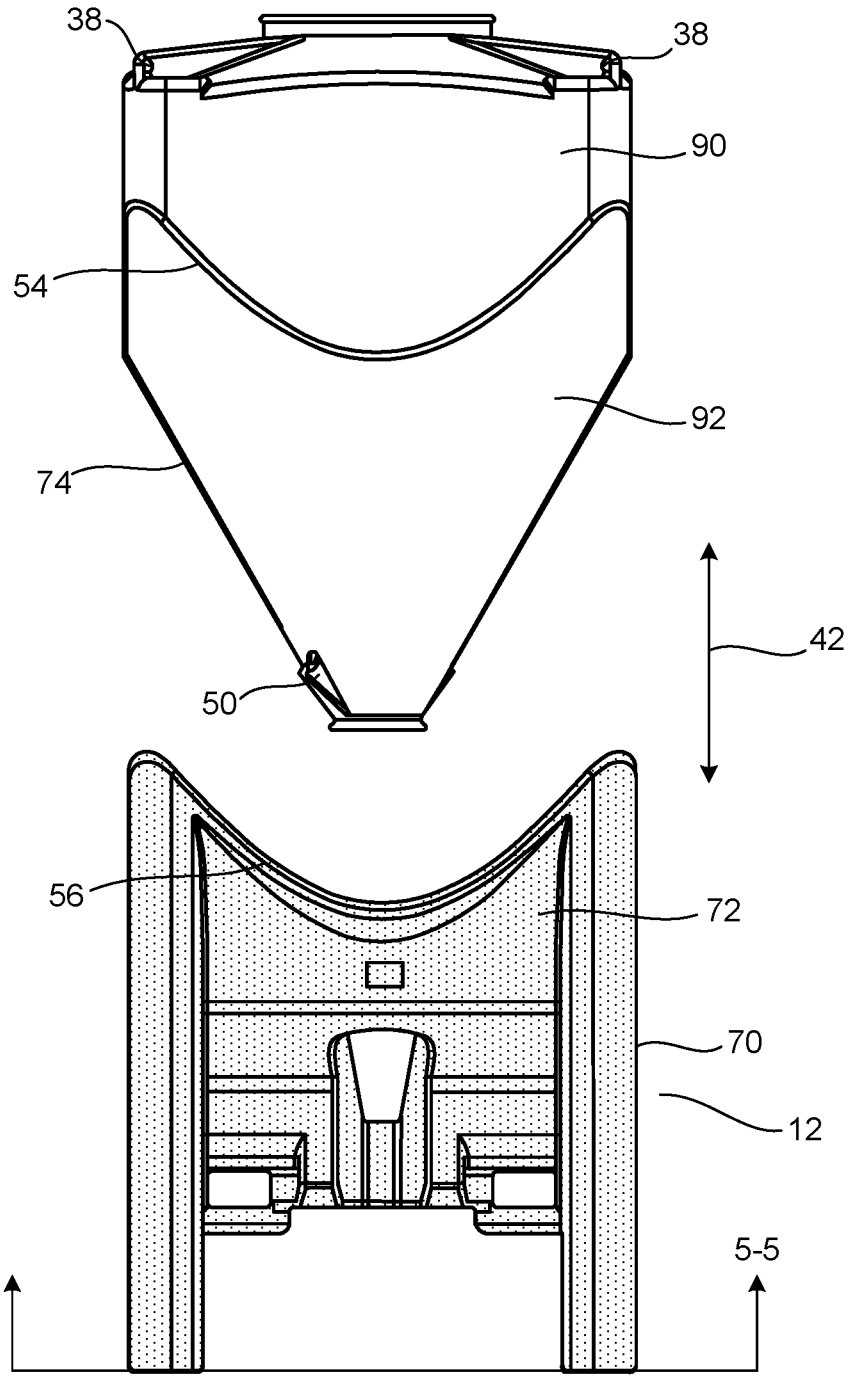
FIG. 4 illustrates further details of the bottle and base, the cooperation therebetween.

FIG. 4 illustrates additional features of the bottle and base. As shown, the bottle of the disclosed embodiment comprises integral upper and lower wall sections 90, 92. The upper wall section 90 has a generally rectangular cross section, and the lower wall section 92 is frustoconical, and has tapered walls 74 that meet the upper wall section 90 to form four arcuate transition regions 54. See FIGS. 6 and 11. Two such transition regions are shown in greater detail in FIG. 6, which illustrates how the transition regions are situated about the vertical axis 58 of the bottle. Integrally disposed adjacent the circular discharge opening are a pair of locking tabs 50, described in further detail below.

A tapered inner wall 72 defines an interior section of the base and has dimensions that generally conform to the dimensions of the lower wall section 92 of the bottle. See FIG. 8. The inner wall 72 serves as cradle for holding the bottle. The outer wall 70 and the inner wall 72 of the base meet to form arcuate edges 56 having dimensions that generally conform to the those of the arcuate transition regions 54. Accordingly, when the bottle has been received into the base, the walls 74 of the bottle rest against the inner wall 72 of the base (see FIG. 7), and the arcuate transition regions 54 of the bottle and the arcuate edges 56 of the base meet in a complementary fashion. As shown by arrow 42 (FIG. 6), the bottle may be lifted out of, and lowered into, the cradle of the base by means of lifting hooks that engage apertures 38.

Figure 5:
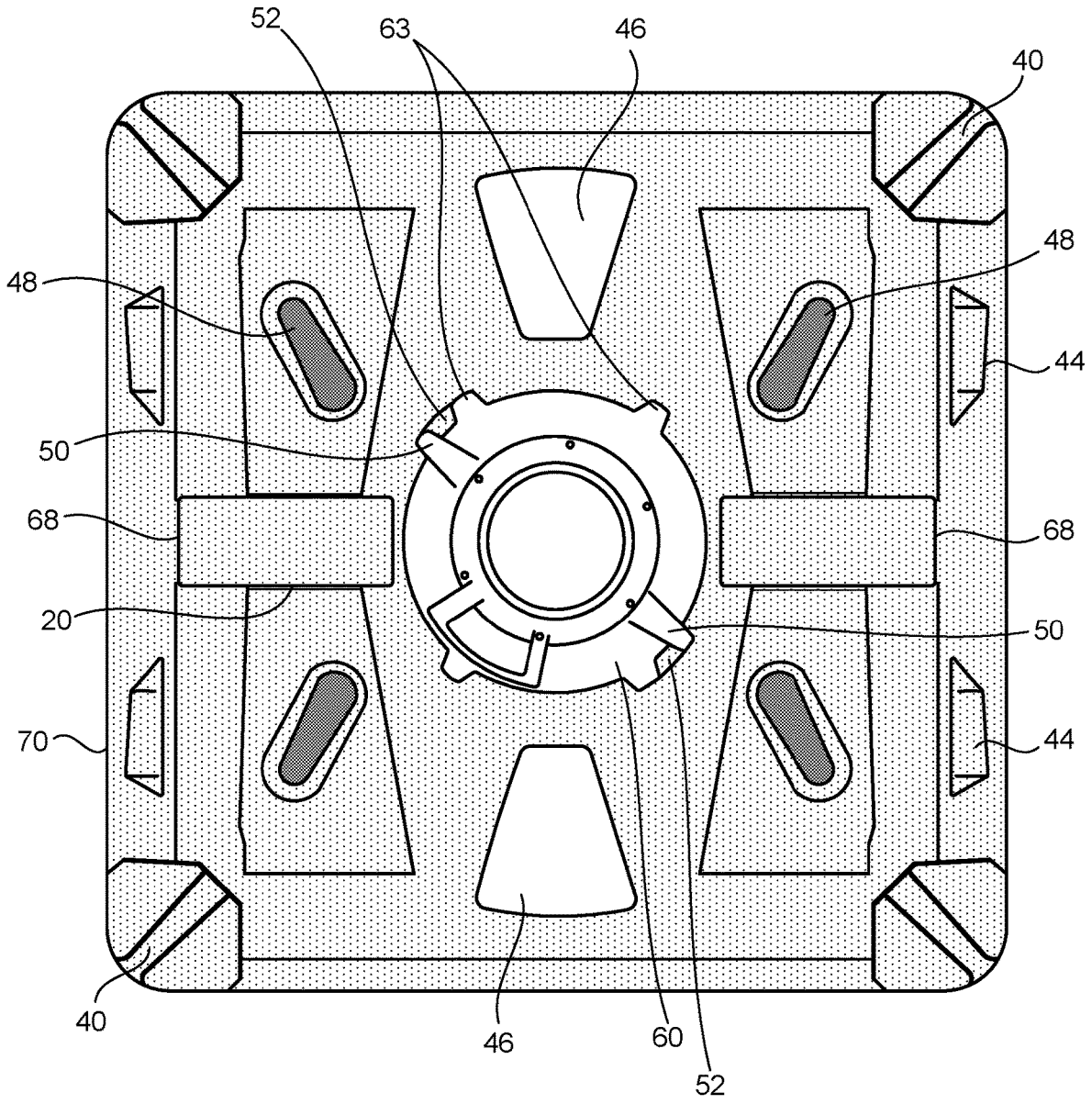
FIG. 5 is a bottom view of the base taken above line 5-5 of FIG. 4.
Figure 6:
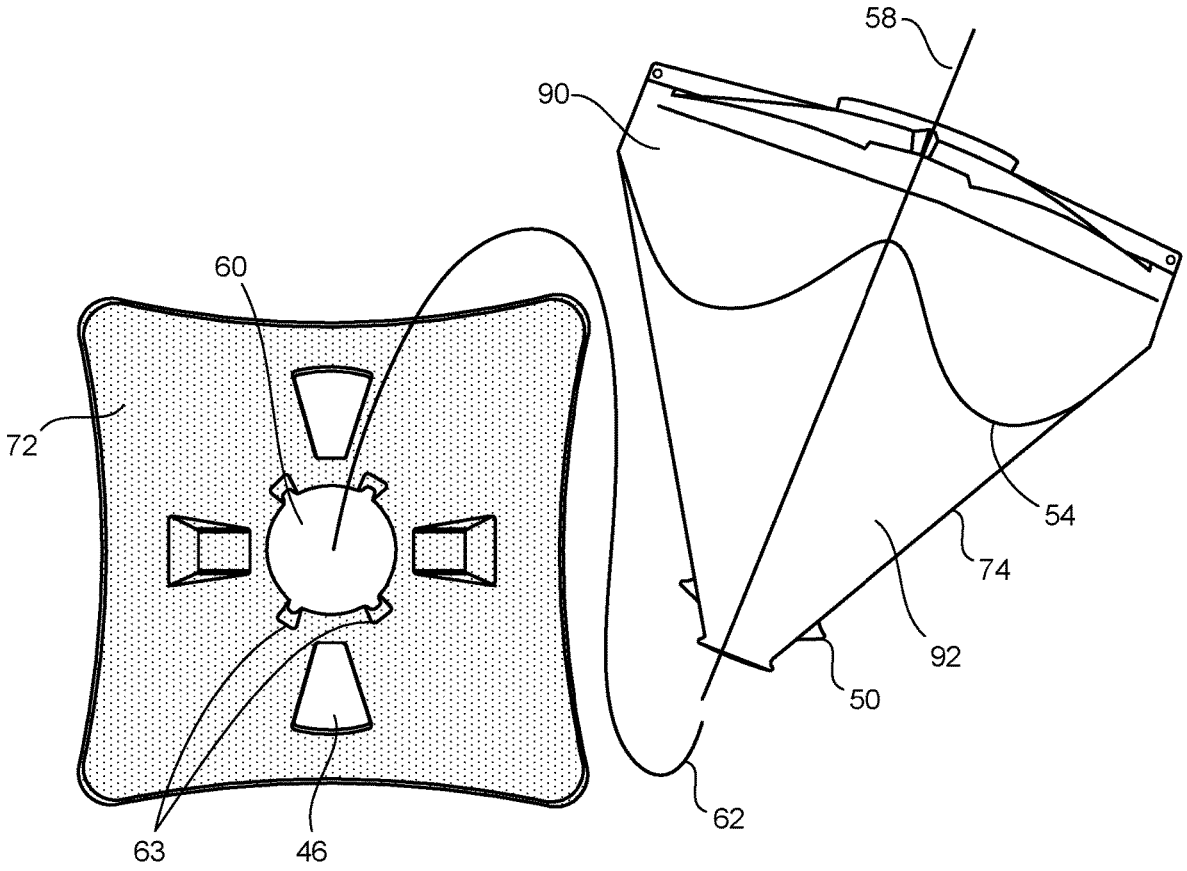
FIG. 6 illustrates further details of the cooperation between the bottle and the base.

FIG. 5 (which is a cross section taken through line 5-5 of FIG. 4) and FIG. 6 illustrate further details of the base and the cooperation between the base and the bottle. As shown in FIG. 6 (the left side of which is a top view of the base), there is a bottle receiving opening 60 at the bottom of the base. The bottle receiving opening is formed by the bottom terminal edge (i.e., periphery) of the inner wall 72 and is adapted to receive the bottommost portion of the bottle. Disposed about the periphery of the bottle receiving opening are a plurality of notches 63 adapted receive the locking tabs 50 when the bottle has been received into the base, Turning back to FIG. 5, and as described more fully hereinafter, there are integrally formed engagement ledges 52 disposed adjacent some, but not all, of the notches 63 that are adapted to engage with the locking tabs 50. Also molded integrally with the bottom of the base are a pair of brackets 68, extending from an area adjacent the bottle receiving opening 60 to the outer wall 70, that form the forklift pockets 20. FIG. 5 also illustrates a cross section of the aesthetic feature 48, the viewing ports 46, and the notches 40 in the legs. As described below, there are cavities 94 (see FIG. 7) formed between the outer wall 70 and the inner wall 72 in which there are disposed integral, hollow support columns 48 (see FIGS. 9 and 10). The support columns 48 serve to distribute a load from the contents of the bottle to the times of the forklift. Thus, as shown in FIG. 8, when the times of the forklift are inserted into the forklift pockets (arrows 72), the bottoms of support columns 48 are disposed directly over the times so as to receive the load transmitted from the bottle by the support columns.

Figure 7:
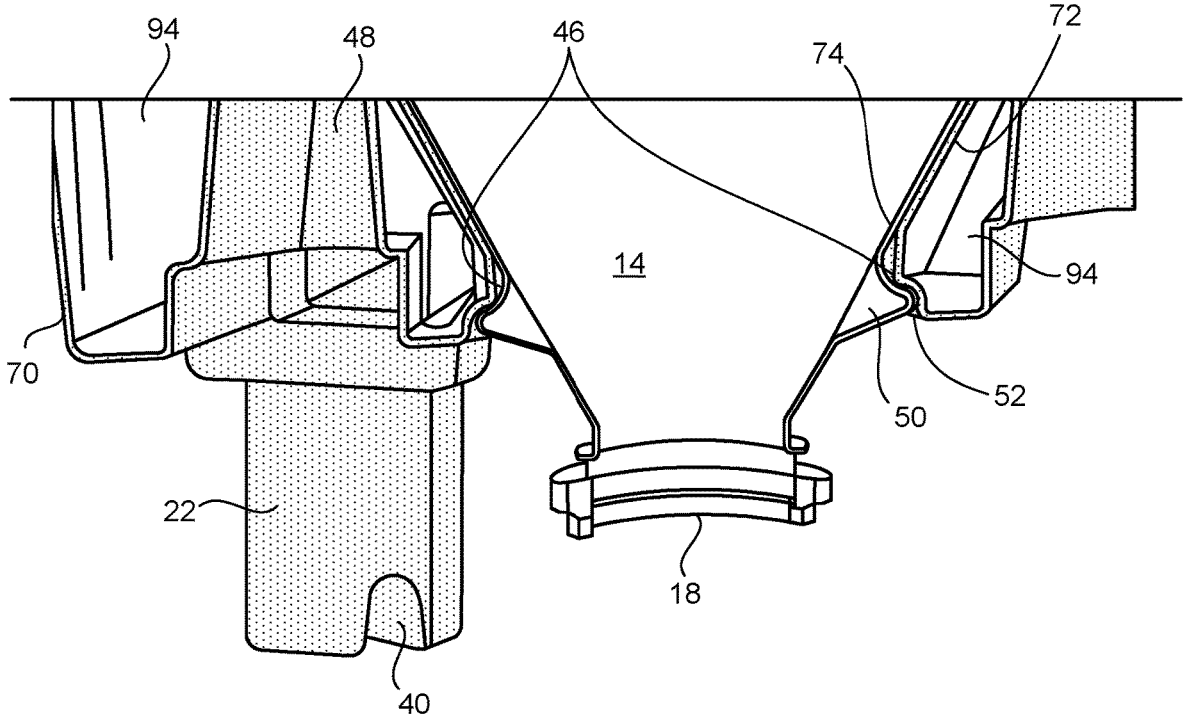
FIG. 7 is a cross section through the bottom portion of the assembled base and bottle.
Figure 13:
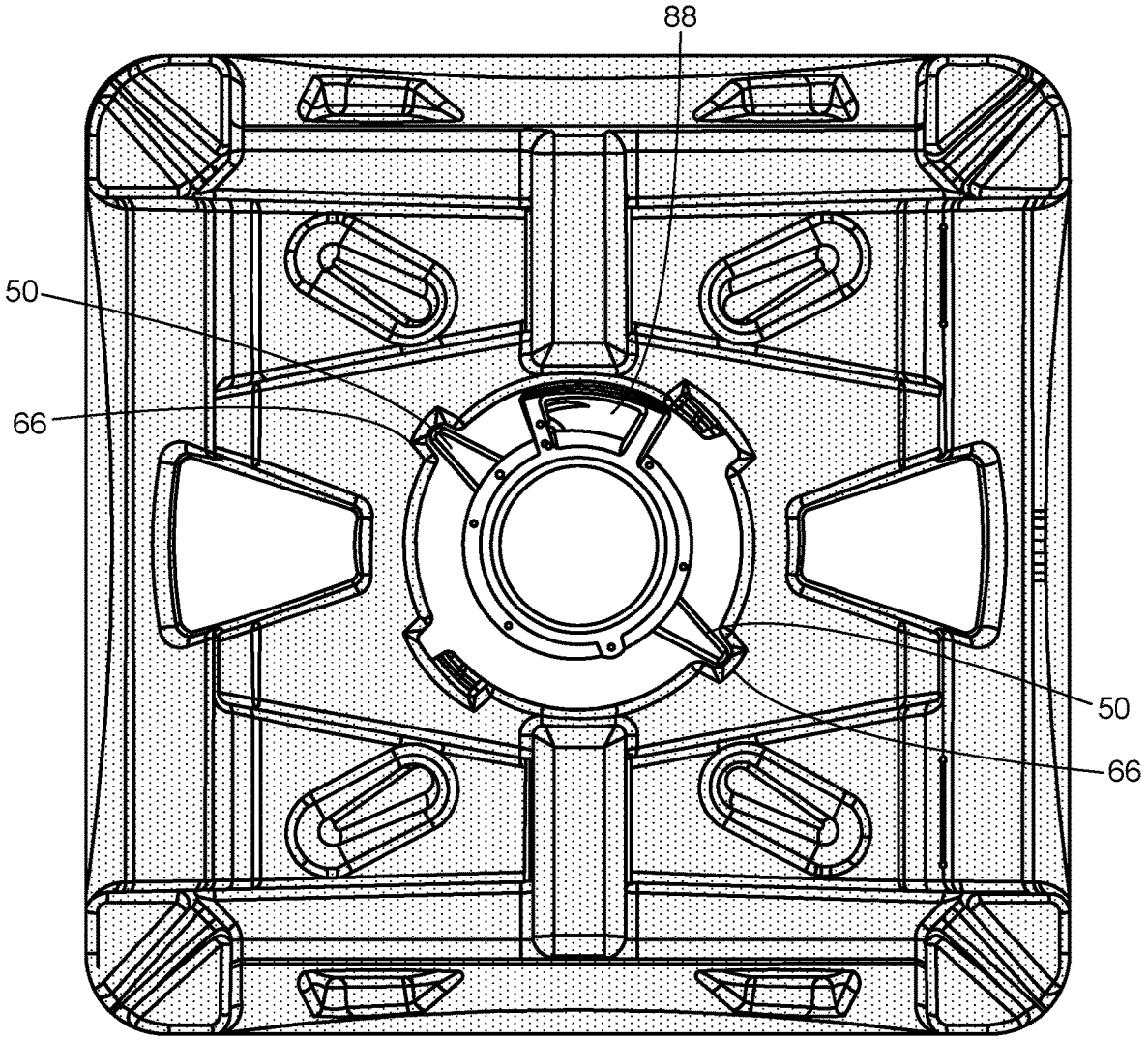
FIG. 13 view of the underside of the base and illustrates the bottle disposed therein in the second orientation.

FIGS. 7, 12 and 13 illustrate the cooperation between the locking tabs 50 and notches 63. As shown in FIG. 12, when the bottle has been received into the base, such that the locking tabs are received into first notches 64 (first orientation), the bottle can be slightly rotated such that the tops 86 of the locking tabs slide over, and engage, the engagement ledges 52. See FIG. 7. Detents in the engagement ledges, formed by slight, integral protrusions extending therefrom, may be provided to cause the bottle to snap and/or lock into place when the bottle is thus rotated. In this manner, the bottle is secured to the base. Rotation of the bottle in the opposite direction disengages the locking tabs from the engagement ledges and allows the bottle to be removed. There are no engagement ledges disposed adjacent second notches 66. Thus, as shown in FIG. 13, when the bottle has been received into the base, such that the locking tabs are received into second notches 66 (second orientation), the bottle is not able to be secured to the base and can be freely removed without the need to disengage it.

Figure 8:
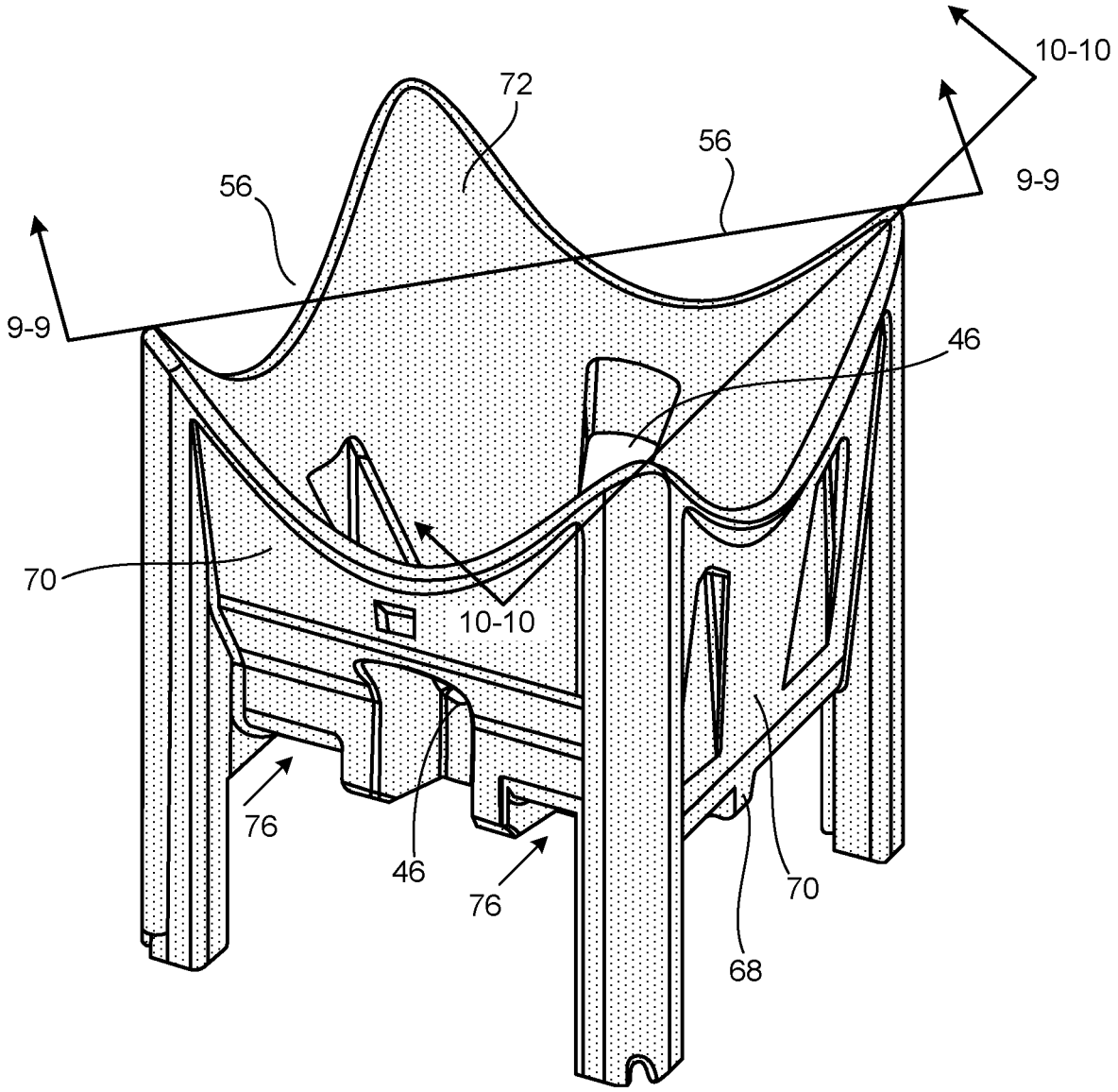
FIG. 8 is a perspective view of the base illustrating further details thereof.
Figure 9:
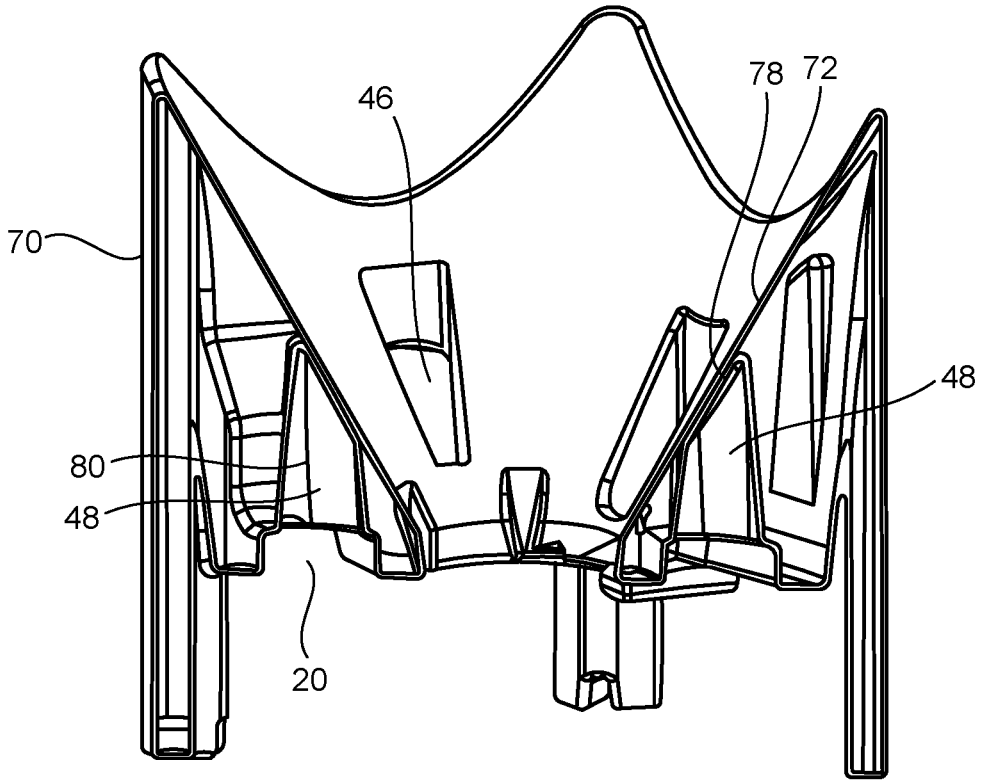
FIG. 9 is a cross section view taken through line 9-9 of FIG. 8.
Figure 10:
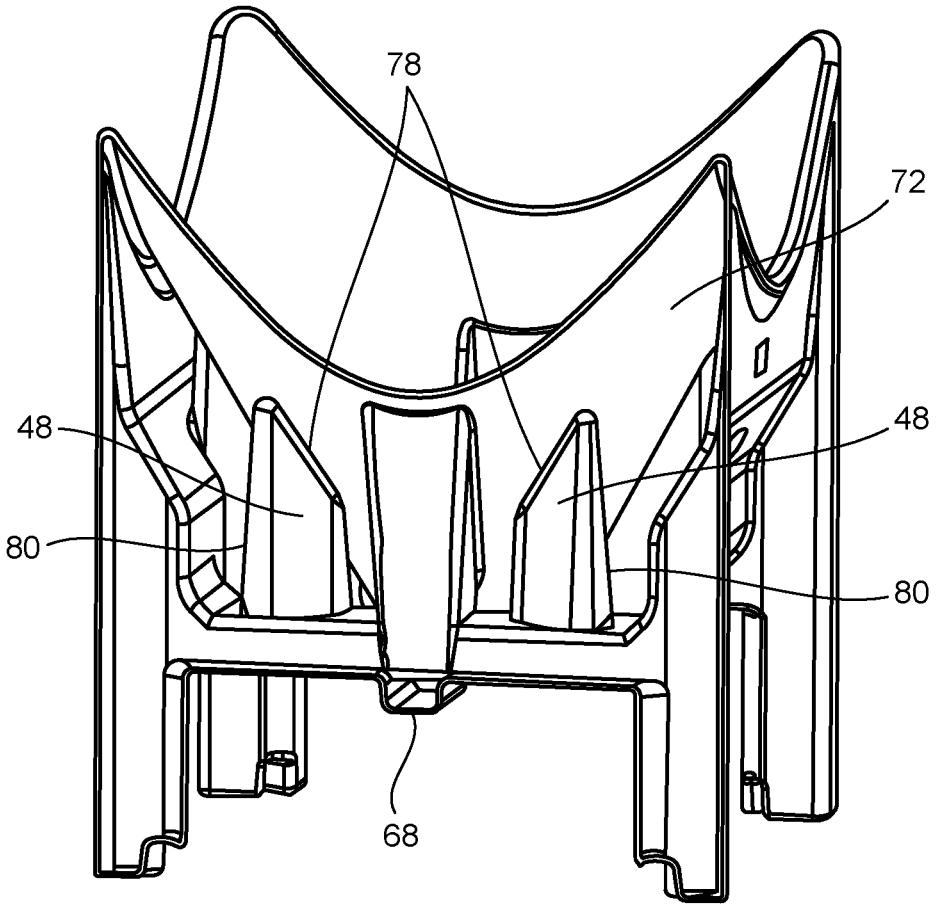
FIG. 10 is cross section view taken through line 10-10 of FIG. 8.

FIGS. 9 and 10 are cross sections taken through line 9-9 and line 10-10, respectively, of FIG. 8, and illustrate internal details of the base. Particularly, details of the support columns 48 are illustrated. As shown in FIGS. 5 and 7, a proximal end of each of the four columns 48 originates at the bottom of the base, and the columns are disposed on opposing sides of the forklift pockets 20. As shown in FIG. 7, the walls of each column 48 are extruded so as to extend from the bottom of the base through the cavities 94 defined by the tapered spaces between the exterior wall 70 and interior wall 72. As shown in FIGS. 9 and 10, a distal end 78 of each column 48 is slanted to conform to the taper of the interior wall 72 and terminates at the interior wall such that substantial continuous contact is formed between the slanted distal end 78 and the interior wall 72. In addition, the longitudinal portion 80 of each column is formed so as to be in substantial continuous contact with the exterior wall 70. Preferably, each column is hollow. Those skilled in the art will appreciate that, through the molding process, the distal ends 78 are formed integrally with the inner wall 72 and the longitudinal portions 80 are formed integrally with the exterior wall. These contact portions are sometimes known in the art as "kiss-offs". Due to the positioning of the columns 48 relative to the lift pockets 20, the existence of the kiss-offs between the slanted ends 78 of the columns and the interior wall 72, and the kiss-offs between the longitudinal portions 80 of the columns and the exterior wall 70, any load created by material in the bottle will, when the bottle is in the cradle, be transmitted by the support columns to the proximal ends thereof, i.e., the ends of the columns at the underside of the base. Accordingly, when the system is raised by a forklift, the load is distributed to the forklift's times.

There has thus been described a dry bulk hopper system that embodies various novel and non-obvious features. The system described herein may be embodied in other specific forms without departing from the spirit or essential attributes thereof. Accordingly, reference should be made to the appended claims, rather than the foregoing specification, for indicating the scope of this application.

What is claimed is:

1. A hopper system comprising:

a thermoplastic bottle comprising: (i) a frustoconical wall tapered to form a circular discharge opening at a bottom end of the bottle, and (ii) outwardly protruding locking tabs formed integral with the frustoconical wall adjacent the discharge opening; and, a thermoplastic base adapted to receive the bottle comprising: (i) a frustoconical cradle formed in an interior of the base and having an interior wall tapered to form a circular bottle receiving opening at a bottom end of the cradle and adapted to receive the bottom end of the bottle, the cradle having dimensions adapted to allow the frustoconical wall of the bottle to rest against the interior wall of the cradle; (ii) integral legs adapted to support the base on a support surface such that the bottle receiving opening is spaced from the support surface by the legs when on the support surface; (iii) a plurality of spaced apart first and second notches formed circumferentially about the bottle receiving opening; and, (iv) integral engagement ledges formed adjacent the first notches but not the second notches;

wherein, when the base has received the bottle: (i) in a first orientation of the bottle relative to the base, the locking tabs are received into the first notches and are adapted to engage the engagement ledges by rotation of the bottle relative to the base so as to secure the bottle to the base; and, (ii) in a second orientation of the bottle relative to the base, the locking tabs are received into the second notches and cannot engage the engagement ledges, such that the bottle is not secured to the base.

2. The hopper system according to claim 1 wherein the bottle and base are formed by a rotational molding process.

3. The hopper system according to claim 1 wherein the locking tabs taper in the same direction as the taper of the frustoconical wall of the bottle, each most outwardly protruding portion thereof comprising a top portion adapted to engage the engagement ledges.

4. The hopper system of claim 3 wherein the engagement ledges comprise integral detents that cooperate with the top portions of the locking tabs to secure the bottle relative to the base when the bottle has been received into the base in the first orientation and rotated relative to the base.

5. The hopper system according to claim 1 wherein: (i) the frustoconical wall forms a lower portion of the bottle, the bottle further comprising an upper wall that is generally rectangular in cross section, there being a plurality of arcuate transitions between the upper wall and the frustoconical wall; and, (ii) the base comprises upper arcuate edges that generally conform to the arcuate transitions of the bottle.

6. The hopper system according to claim 5 wherein the bottle comprises a fill opening formed at a top end thereof, and a plurality of spaced apart thermoplastic support beams integrally formed in the top end of the bottle, each support beam extending from an area adjacent the fill opening to a corner of the rectangular wall.

7. The hopper system of claim 6 wherein each support beam comprises an aperture at an end distal from the fill opening adapted to receive a lift hook.

8. The hopper system of claim 1 wherein the bottle further comprises a valve disposed over the discharge opening for retaining contents in the bottle when the valve is closed and for discharging contents of the bottle when the valve is open.

9. The hopper system according to claim 1 wherein the base further comprises an integral thermoplastic, generally rectangularly shaped, outer wall spaced apart from the inner wall so as to define a plurality of tapered cavities therebetween, and a pair of forklift pockets defined by integral thermoplastic brackets straddling opposing bottom edges of the outer wall and bottom areas of the base adjacent the discharge opening, the forklift pockets each being configured to receive a time of a forklift for lifting the base.

10. The hopper system according to claim 9 further comprising an integral support column formed in each cavity, each support column extending from a bottom area of the base to at least the inner wall, each column being a hollow extrusion of thermoplastic having elongate walls having portions in continuous contact with portions of the inner and outer walls, wherein, when a bottle containing contents is disposed in the base and the base is raised by a forklift, the support columns distribute a load from contents of the bottle to the times of the forklift.

11. A hopper system comprising:

a rotationally molded thermoplastic bottle comprising: (i) an upper wall having a generally rectangular cross section; (ii) a top section integral with the upper wall and having a fill opening formed therein; (iii) a lower frustoconical wall integral with the upper wall that tapers from the upper wall to form a discharge opening at a lowermost portion of the bottle, there being a plurality of arcuate transitions from the upper wall to the lower wall; and, (iv) at least two integral locking tabs formed by extrusions of the frustoconical wall adjacent the discharge opening; and, a rotationally molded base adapted to receive the bottle comprising: (i) an inner frustoconical wall, defining a cradle, that tapers to form a receiving opening at a bottom end of the base, the inner wall having a plurality of arcuate top edges adapted to cooperate with the arcuate transitions of the bottle; (ii) an integral outer wall, having a generally rectangular cross section, at least portions thereof spaced apart from the inner wall to define cavities between the inner and outer walls; (iii) notches formed about the periphery of the receiving opening adapted to receive the locking tabs; (iv) engagement ledges formed adjacent to at least some of the notches and adapted to engage with the locking tabs; (v) an integral support column disposed in each cavity, each support column extending from a bottom area of the base to at least the inner wall and being a hollow extrusion of thermoplastic having elongate walls having portions in continuous contact with portions of the of the inner and outer walls; and, (vi) a pair of forklift pockets defined by integral brackets straddling opposing bottom edges of the outer wall and bottom areas of the base adjacent the discharge opening, the forklift pockets each being configured to receive a time of a forklift for lifting the base.

12. The hopper system according to claim 11 further comprising a plurality of legs integral with the base adapted to support the base on a support surface and to maintain the receiving opening a spaced distance from the support surface.

13. The hopper according to claim 11 wherein the notches comprise first and second notches and the engagement ledges are formed adjacent the first notches but not the second notches, and further wherein, when the base has received the bottle: (i) in a first orientation of the bottle relative to the base, the locking tabs are received into the first notches and are adapted to engage the engagement ledges by rotation of the bottle relative to the base so as to secure the bottle to the base; and, (ii) in a second orientation of the bottle relative to the base, the locking tabs are received into the second notches and cannot engage the engagement ledges, such that the bottle is not secured to the base.

14. The hopper system according to claim 13 wherein the engagement ledges further comprise integral detents that cooperate with the locking tabs to secure the bottle relative to the base when the bottle has been received into the base in the first orientation and rotated relative to the base.

15. The hopper system according to claim 12 further comprising a fill opening in the top section of the bottle and a plurality of support beams integral with the top section, each support beam extending from the fill opening to a corner of the upper wall of the bottle.

16. The hopper system according to claim 15 further comprising apertures disposed at ends of the support beams distal from the discharge opening and adapted to receive a lift hook.

17. The hopper system of claim 11 further comprising at least two inspection ports formed in a lower portion of the base and adapted to allow a portion of the bottle to be viewed while being received into the base.

18. The hopper system according to claim 15 further comprising longitudinal notches integrally formed at the bottom of each leg and each adapted to receive a portion of the support beam of another bottle, so as to allow stacking of one hopper system on another hopper system.

19. The hopper system according to claim 11 further comprising a valve disposed over the discharge opening for retaining contents in the bottle when the valve is closed and for discharging contents of the bottle when the valve is open.

20. A hopper system comprising:

a rotationally molded thermoplastic bottle comprising: (i) an upper wall having a generally rectangular cross section; (ii) a lower frustoconical wall integral with the upper wall that tapers to form a discharge opening at a lowermost portion of the bottle, there being a plurality of arcuate transitions from the upper wall to the frustoconical wall; and, (iii) outwardly protruding locking tabs formed integral with the frustoconical wall adjacent the discharge opening and tapering from a top end to a bottom end thereof in the same direction as the taper of the frustoconical wall; (iv) a fill opening formed in a top end of the bottle; (v) a plurality of spaced apart support beams integrally formed in the top end of the bottle each extending from an area adjacent the fill opening to a corner of the outer wall, each support beam having a aperture formed therein at an end distal from the fill opening and adapted to receive a lift hook; and, a thermoplastic base adapted to receive the bottle comprising: (i) an outer wall having a generally rectangular cross section; (ii) an inner tapered wall that generally conforms to the dimensions of the frustoconical wall of the bottle, defining a cradle, adapted to allow the bottle to rest in the cradle, there being a bottle receiving opening at a bottom end of the cradle adapted to receive the lowermost portion of the bottle; (iii) upper arcuate edges that generally conform to the arcuate transitions of the bottle; (iv) integral legs adapted to allow the base to rest on a support surface such that the bottle receiving opening is spaced from the support surface by the legs when on the support surface; (v) a plurality of spaced apart first and second notches formed circumferentially about the periphery of the bottle receiving opening; (vi) integral engagement ledges formed adjacent the first notches but not the second notches, each engagement ledge having an integral detent that cooperates with top portions of the locking tabs, wherein, when the base has received the bottle in a first orientation of the bottle relative to the base, the locking tabs are received into the first notches and are adapted to engage the engagement ledges by rotation of the bottle relative to the base so as to secure the bottle to the base, and in a second orientation of the bottle relative to the base, the locking tabs are received into the second notches and cannot engage the engagement ledges, such that the bottle is not secured to the base; (vii) a pair of forklift pockets defined by integral brackets straddling opposing edges of the outer wall and bottom areas of the base adjacent the discharge openings, the forklift pockets each being configured to receive a time of a forklift for lifting the base; (viii) a plurality of cavities between the inner and outer wall; and, (ix) an integral support column disposed in each cavity for distributing a load from contents of the bottle to the times of the forklift.

* * * * *